US005810033A

United States Patent [19]

Nakayama et al.

[11] Patent Number: 5,810,033

[45] Date of Patent: Sep. 22, 1998

[54] FUEL TANK FOR CIRCULATING CARBURETOR

[75] Inventors: Yoshiki Nakayama, Akishima; Tatsuhiko Matsubayashi, Kamakura; Shunsuke Nakadate, Hamura, all of Japan

[73] Assignee: Kioritz Corporation, Tokyo, Japan

[21] Appl. No.: 725,547

[22] Filed: Oct. 3, 1996

[30] Foreign Application Priority Data

Oct. 6, 1995 [JP] Japan ..... 7-286501

[51] Int. Cl.[6] ..... E03B 11/00

[52] U.S. Cl. ..... 137/574; 137/576; 123/514

[58] Field of Search ..... 137/574, 590, 137/576; 123/514

[56] References Cited

U.S. PATENT DOCUMENTS

| | | | |
|---|---|---|---|
| 4,136,652 | 1/1979 | Lee | 123/514 |
| 4,703,771 | 11/1987 | Mimura | 137/574 |
| 5,263,458 | 11/1993 | Fujino et al. | 137/574 |
| 5,429,095 | 7/1995 | Aodai et al. | 123/514 |

FOREIGN PATENT DOCUMENTS 49-40175 11/1974 Japan .

OTHER PUBLICATIONS

English Abstract of Japanese Utility Model Application No. 3540/1973.

English Abstract of Japanese Utility Model Application No. 40175/1974.

*Primary Examiner*—Denise L. Ferensic
*Assistant Examiner*—John Ball
*Attorney, Agent, or Firm*—Michael D. Bednarek; Kilpatrick Stockton LLP

[57] ABSTRACT

A fuel inlet is disposed on the upper part of a fuel tank which is protruded upwardly and a connecting portion of a return pipe is located which is also protruded on the upper part of the fuel tank being separated from the fuel inlet and an air reservoir is disposed within the connecting portion of the return pipe. When fuel is poured through the fuel inlet, fuel will not go into the air reservoir. Therefore, vibrations given to the fuel tank does not cause the return pipe blocked at its lower end, allowing overflown fuel to be returned smoothly back to the fuel tank.

3 Claims, 2 Drawing Sheets

FUEL TANK FOR CIRCULATING CARBURETOR

FIELD OF THE INVENTION

The present invention relates to a fuel tank for a circulating carburetor wherein fuel overflown from a carburetor is returned back to the fuel tank via a return pipe.

BACKGROUND OF THE INVENTION

In a circulating carburetor, when an internal combustion engine is started, fuel is provided from a fuel tank through a suction pipe to a fuel chamber of the carburetor by the action of a pump, then required amount is supplied from a main jet to the internal combustion engine.

It is so constructed that the fuel which has overflown form the fuel chamber of the carburetor is returned through a return pipe back to the fuel tank and is used again.

In a grass trimmer, for example, which is equipped with an internal combustion engine having a circulating carburetor configured as described above, an operator usually work and move with a operating rod bearing the internal combustion engine on his/her back. Vibrations are created and given to the fuel tank whenever the operating rod is lifted up or the machine is moved by working processes. Therefore, if the tank is full of the fuel, a lower end of the return pipe is easily clogged by the fuel when vibrations occur and the flow of the fuel which has overflown from the fuel chamber of the carburetor and which should be returned back to the fuel tank is impeded, causing the fuel to be jetted out from an air vent and resulting in an engine trouble.

To overcome this problem, a fuel tank having a narrowed lower end of a return pipe connected to the fuel tank and having a vent with a small diameter on the narrowed part has been proposed (Japanese examined Utility Model Specification No. 40175/1974). Another fuel tank having a bulged portion connecting to a return pipe of a fuel tank and having a pipe passing through the bulged portion to the lower position of the fuel level within the tank and also having a vent disposed within the bulged portion at a top end of the pipe has been also proposed (Japanese examined Utility Model Specification No. 3540/1973).

These apparatuses, however, are still not enough effective because, when the tank is full of fuel, expected functions have not been obtained, being not free of inconvenience.

SUMMARY OF THE INVENTION

It is an object of the present invention to provide a fuel tank which can prevent a return pipe from being blocked at its lower end by fuel even when the fuel tank is filled up and vibrations are given to the tank.

To achieve the object, according to the present invention, a fuel inlet is disposed on the upper part of a fuel tank which protrudes upwardly and a connecting portion of a return pipe is also protruded upwardly so adapted to be separated from the fuel inlet and within the connecting portion an air reservoir is formed therein. In the fuel tank of the present invention, even the fuel fills up the tank, it will not go into the air reservoir.

Therefore, even if vibrations are given to the fuel tank when the tank is full of fuel, the air reservoir can prevent the return pipe from being blocked at its lower end by fuel.

The fuel tank of the present invention also prevents the stop of the flow of the overflown fuel which should be returned back to the fuel tank which have so far caused the fuel to be jetted out from an air vent and induced an engine trouble.

DETAILED DESCRIPTION OF THE INVENTION

Figure 1:
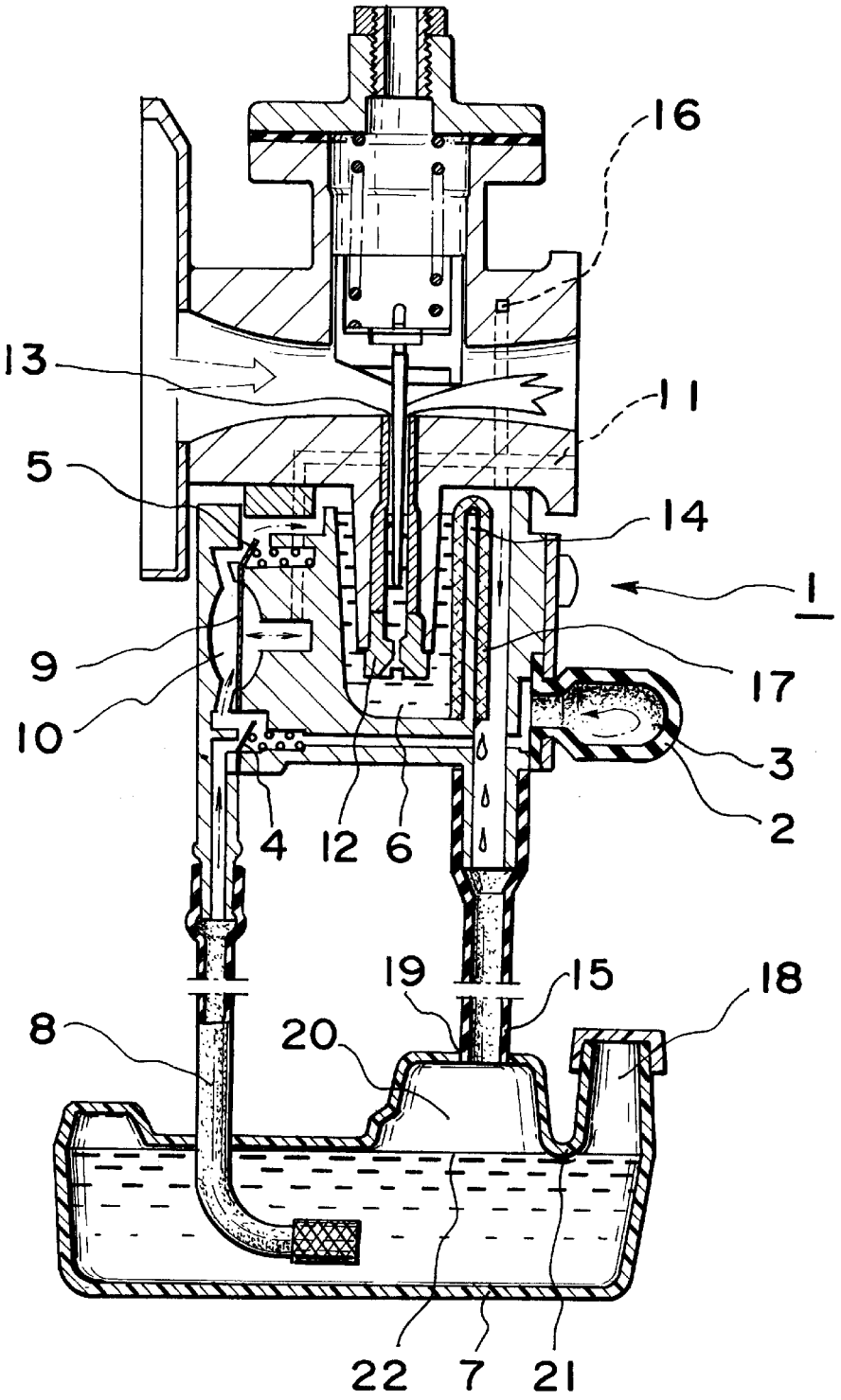
FIG. 1 is a longitudinal sectional view showing a circulating carburetor and a fuel tank for a circulating carburetor of one embodimen the present invention.

The present invention will now be further described with reference to the accompanying drawings. One of embodiments of a circulating carburetor is shown in FIG. 1. Previous to starting an internal combustion engine such as an air-cooled two cycle gasoline engine and the like (not shown), when a bulge 2 of a carburetor 1 is pushed several times, an air pressure within a pump chamber 3 disposed inside the bulge 2 is varied, allowing check valves 4 and 5 to be opened or closed which causes a pressure within space between the check valves 4 and 5 to be lowered.

As a result, fuel in a fuel tank 7 is sucked through an inlet pipe 8 via one of the check valves 4 into a pressure chamber 10 which is compacted by a diaphragm 9 and is also supplied via the other of the check valves 5 to a fuel chamber 6 of the carburetor 1.

After the internal combustion engine has started, a pressure pulse (positive and negative pressure) is transmitted from the inside of a crank case of the internal combustion engine via a pulse path 11 to the back side of the diaphragm 9, thereby causing a pressure in the pressure chamber 10 compacted by the diaphragm 9 to be varied and the diaphragm 9 to be continuously activated as a pump which allows fuel in the fuel tank 7 to be sucked continuously and to be supplied to the fuel chamber 6 of the carburetor 1.

Furthermore, the fuel supplied to the fuel chamber 6 of the carburetor 1 is measured by a main jet 12 and jetted out of a needle jet 13 and, after being mixed with air from an air cleaner (not shown), is sucked into a cylinder of the internal combustion engine.

The fuel supplied continuously to the fuel chamber 6 of the carburetor 1 overflows out from a weir 14 and is returned back to the fuel tank 7 via a return pipe 15.

The reference numeral 16 in FIG. 1 shows an air vent used to release air to the atmosphere from the side of the fuel chamber 6 of the carburetor 1.

While the internal combustion engine is stopped, the fuel residing in the fuel chamber 6 of the carburetor 1 is adapted to be automatically discharged within a preset time (approximately 60 minutes) by a siphon effect of a drain wire 17 which is disposed to cover the weir 14 into the fuel tank 7.

The present invention relates to a fuel tank used for a circulating carburetor configured as described above.

As shown in FIG. 1, a fuel tank 7 as one embodiment of the present invention is provided with a fuel inlet 18 which protrudes upwardly and with a connecting portion 19 communicating with a return pipe 15 which also protrudes upwardly, forming an air reservoir 20 under the protruded return pipe 15 which is separated by a part of the fuel tank 7 from the fuel inlet 18. "To separate" the air reservoir 20 from the fuel inlet 18 by using a part of the fuel tank 7 at the connecting portion 19 means that the fuel inlet 18 is separated from the connecting portion 19 of the return pipe 15 and, as viewed in FIG. 1, a separating portion 21 is provided between the air reservoir 20 and the fuel inlet 18.

In other words, on the upper part of the fuel tank 7, the connecting portion 19 of the return pipe 15 and the fuel inlet 18 are disposed, both of which are protruded upwardly, but separately.

Figure 2:
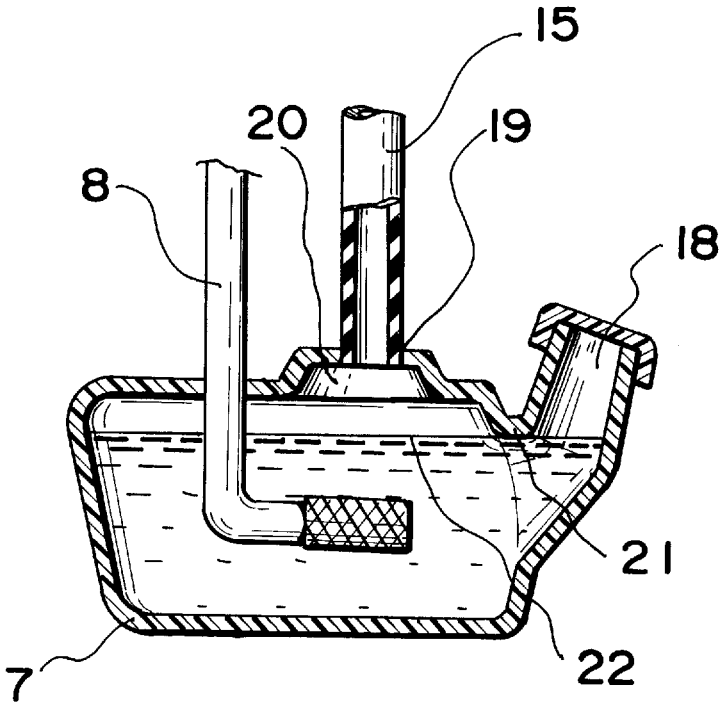
FIG. 2 is a longitudinal sectional view of another embodiment of the present invention.

FIG. 2 is another embodiment of the fuel tank for a circulating carburetor of the present invention. Almost of all the part of a connecting portion 19 of a return pipe 15 which is comparted by a separating portion 21 is protruded upwardly. The separating portion 21 is molded integrally when a fuel tank 7 is manufactured.

According to the present invention, the fuel inlet 18 on the upper side of the fuel tank 7 is separated by the separating portion 21 from the connecting portion 19 of the return pipe 15 and the air reservoir 20 is located within the space surrounding the connecting portion 19 of the return pipe 15.

Accordingly, even if the fuel is poured through the fuel inlet 18 into the fuel tank 7 almost to the extent that the fuel tank 7 is full, the fuel will not fill up the air reservoir 20. Moreover, even if vibrations are given to the fuel tank 7, the fuel will not clog up the space located under the return pipe 15. Such cases will not occur as the flow of the fuel which should be returned back to the fuel tank 7 is stopped, causing the fuel to be jetted from the air vent 16 or somewhere else.

In the blow molding of the fuel tank 7, the bottom position of the separating portion 21 is preferably set as a horizontal parting line 22 for upper and lower molds. The parting line 22 can be used as a guide for supplying the fuel. The fuel tank 7 is produced by molding using translucent plastics as a material which allows the level of the fuel to be seen through the plastics.

Moreover, according to the present invention, the fuel tank 7 can be fabricated simply by integral molding, unlike other conventional tanks, requiring neither attachment of other accessories nor assembling process, thus providing a cost-competitive tank.

What is claimed is:

1. A fuel tank for a circulating carburetor comprising:

a fuel inlet having a neck disposed on the upper part of the fuel tank;

a protruding connecting portion for receiving dripped fuel from a return pipe disposed on the upper part of the fuel tank;

wherein the protruding connecting portion for the external return pipe is separated from the fuel inlet by a separating portion formed in the neck of the fuel inlet, and wherein the protruding connecting portion for receiving dripped fuel is disposed to contain an air reservoir such that blockage of returning fuel is prevented and wherein the neck extends above the highest point of the protruding connecting portion, such that received dripped fuel cannot fill the tank so as to raise the level of fuel above the level of the neck.

2. The fuel tank of claim 1 wherein the fuel tank is disposed to receive fuel to a maximum level, such that the fuel has a surface at the maximum level, and wherein the return pipe is situated so as to be above the surface of the fuel in the fuel tank at the maximum level so that there is a space between the return pipe and the surface of the fuel.

3. The fuel tank of claim 1 wherein the fuel tank comprises an internal and an external portion, and wherein the return pipe is situated entirely on the external portion of the fuel tank.

* * * * *